United States Patent [19]

Sakai et al.

[11] 4,412,413

[45] Nov. 1, 1983

[54] AIR CURRENT RECTIFIER PLATE ON AN AIR SPINNING DEVICE

[75] Inventors: Shoji Sakai, Kyoto; Michiaki Fujiwara, Shinomachi; Nobunori Kubota; Koshi Noda, both of Kyoto, all of Japan

[73] Assignee: Murata Machinery, Ltd., Japan

[21] Appl. No.: 335,220

[22] Filed: Dec. 28, 1981

[30] Foreign Application Priority Data

Oct. 13, 1981 [JP] Japan ..... 56-152716[U]

[51] Int. Cl.[3] ..... D01H 11/00

[52] U.S. Cl. ..... 57/304; 57/328

[58] Field of Search ..... 57/300, 301, 304, 328

[56] References Cited

U.S. PATENT DOCUMENTS

| | | | |
|---|---|---|---|
| 3,540,201 | 11/1970 | Susami et al. | 57/304 X |
| 3,978,648 | 9/1976 | Yamagata et al. | 57/328 X |
| 3,992,865 | 11/1976 | Tuchida et al. | 57/328 |
| 4,107,911 | 8/1978 | Yamana et al. | 57/304 |
| 4,314,440 | 2/1982 | Onoue et al. | 57/304 X |

*Primary Examiner*—Donald Watkins

*Attorney, Agent, or Firm*—Spensley, Horn, Jubas & Lubitz

[57] ABSTRACT

An air current rectifier plate surrounds the foremost air jet nozzle in an air spinning device. The rectifier plate produces a non-turbulent flow of air toward the waste suction pipe and prevents debris from back-flowing into the air jet nozzle.

13 Claims, 4 Drawing Figures

AIR CURRENT RECTIFIER PLATE ON AN AIR SPINNING DEVICE

BACKGROUND AND SUMMARY OF THE INVENTION

This invention relates to an air current rectifier plate attached to an air nozzle in an air spinning device.

The so-called air spinning process for producing spun yarn comprises passing a yarn sliver through an air-jetting nozzle which imparts twist to the sliver by a swirling stream of jetted air. This process is illustrated in U.S. Pat. No. 3,079,746, U.S. Pat. No. 3,978,648, and U.S. Pat. No. 4,107,911.

In this air spinning process, large quantities of dust and fly wastes are scattered from the air jetting nozzle. When fly wastes are deposited in the vicinity of the spinning nozzle zone, the capacity of the nozzle is reduced and the yarn quality is degraded. Moreover, scattered fly wastes worsen the working environment.

In the past, fly wastes and dust have been removed from the nozzle zone by means of a dust box connected to a suction pipe. However, the air flow exerted by the suction pipe tends to create additional turbulence which redeposits dust in the nozzle zone.

The problem of air turbulance and dust redeposit is especially critical in air spinning systems which utilize multiple nozzle whose alignment and compactness must be maintained to avoid yarn breakage.

The present invention is intended to eliminate these troubles by providing an air current rectifier around the foremost air nozzle unit in order to reduce turbulence both in front of and behind the air nozzle unit and to channel air flow paths towards the dust box.

DESCRIPTION OF THE PREFERRED EMBODIMENT

The following detailed description is of the best presently contemplated mode of carrying out the invention. This description is not to be taken in a limiting sense, but is made merely for the purpose of illustrating the general principles of the invention since the scope of the invention is best defined by the appended claims.

Figure 1:
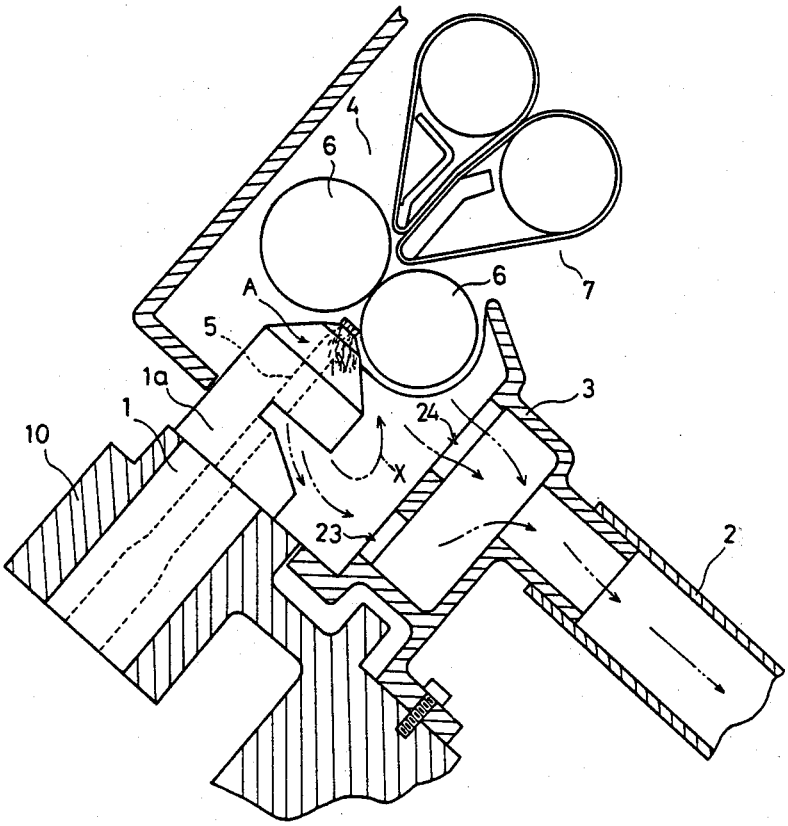
FIG. 1 is a sectional view of a nozzle unit of a spinning device which is not provided with an air current rectifier plate according to the invention.

In an air spinning device as shown in FIG. 1, a dust box 3 connected to a suction pipe 2 is provided near the tip 1*a* of an air nozzle 1 for sucking debris such as fly fibers not sucked into the nozzle 1 and other fly fibers and dust discharged from the first nozzle 5 thrugh cutout portion 11.

However, in the device as shown in FIG. 1, fly waste and dust are deposited on the forward portion A of the nozzle 5 even if the suction force in suction pipe 2 is increased and the deposited debris is again sucked into the first nozzle 5, thereby causing breakage or other defects of yarn. Such troubles as above are caused more frequently when the feeding pressure for jetting air to the first nozzle 5 is raised.

It has been found that deposite of debris as above results from a phenomenon that the air jetted from the first nozzle 5 through the cutout portion 11 is not regularly sucked into the dust box 3. A pair of the air current flows backward (as shown by the arrow marked X) toward the tip of the nozzle unit 1 thereby disturbing the air current in the dust box 3.

Figure 2:
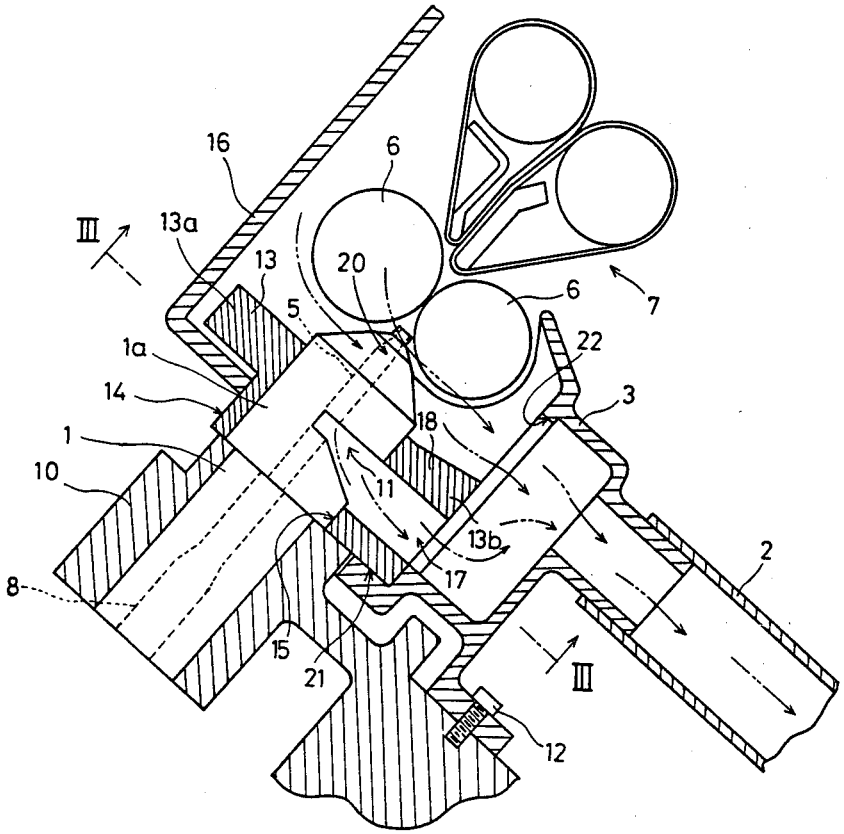
FIG. 2 is a sectional view of a nozzle unit of a spinning device which is provided with an air current rectifier plate according to the invention.

Describing in detail an embodiment of the present invention with reference to FIG. 2, the numeral 1 indicates an air nozzle unit disposed in a zone subsequent to a drafting part 4 consisting of front rollers 6 and aprons 7. The air nozzle unit 1 is comprised of a first nozzle 5 and a second nozzle 8 fitted into and supported by a nozzle holder 10. A cutout part 11, bored in an appropriate position on the tip part 1*a* of nozzle 1, is directed downward for discharging air flowing from the first nozzle 5.

A dust box 3 is fixed so as to surround, from the downside, the air nozzle tip part 1*a* and front rollers 6. An air current rectifier plate 13 according to the present invention is fitted onto the tip part 1*a* of the air nozzle unit 1 and enclosed by said dust box 3.

Figure 3:
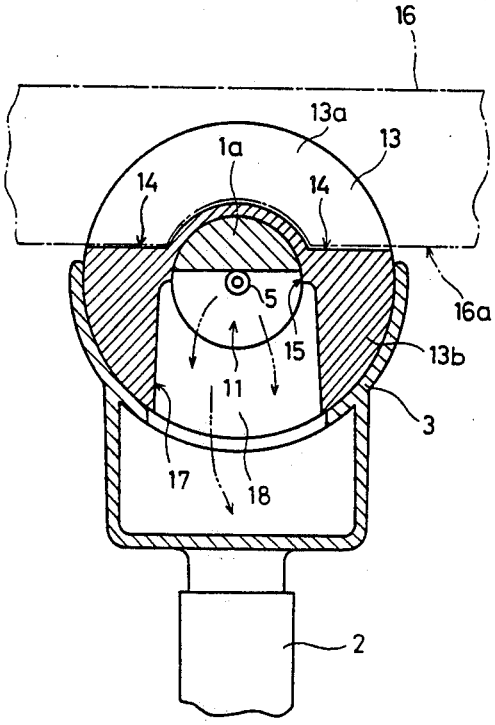
FIG. 3 is a sectional view taken along the line III—III of FIG. 2.

The air current rectifier plate 13 is a disk, fitted on the air nozzle unit 1, having a concentric bore to be fitted rotatably on the nozzle tip part 1*a*. By defining the diameter of the plate 13 so as to fit the internal geometry of the dust box 3, the plate 13 is adapted to lightly rotate in said dust box 3 without producing a gap between the dust box 3 and the plate 13 (FIG. 3).

The upper half 13*a* of the rectifier plate 13 extends to a point which is slightly higher than the uppermost end of the top front roller 6 and close to the cradle cover 16. The lower half 13*b* is provided with a wide air flow path 17 which is bored in a position corresponding to the cutout jetting part 11 of said first nozzle 5 and comunicates with the cutout part. A wall 18 formed by the rectifier plate 13 serves as a partition between the path 17 for the air flowing from the first nozzle 5 and another flow path 20 for the air sucked from the front roller zone toward the dust box 3 across the nozzle unit 1.

The reference numeral 16 represents a cradle cover that can be opened upward. The air current rectifier plate 13 in this embodiment is rotatable around the nozzle tip 1*a* and devised so that the bottom edge of the cradle cover 16 is brought into contact, when completely closed, with a cutout step 14 of the rectifier plate 13. Closing cradle cover 16 thereby rotates plate 13 into a position in which the cutout 11 for the air flowing from said first nozzle 5 communicates with the air flow path 17.

Also, in the above embodiment, as the rectifier plate 13 is provided with a step 14 at the upper part 13*a* thereof, and is in the shape of a disk capable of rotating freely in the dust box 3, it can be automatically put into the correct position by closing the cradle cover whereby great convenience is provided for cleaning the interior of the dust box 3. The rear face 21 of said lower half part 13*b* of the plate 13 is brought into contact with the front face of the nozzle holder 10, which serves as a stopper.

Since the air current in the dust box 3 is rectified by provision of such rectifier plate 13 as above, the opening 22 on the bottom of the dust box 3 is enabled to be wider and in the form of a single opening rather than the two openings 23 and 24 in the dust box 3 shown in FIG. 1.

In the present invention the air flow path to the dust box 3 is partitioned into a path 20 for the sucked air current on the nozzle tip side and another path 17 for the discharged air current from the first nozzle 5. Therefore, fly waste and dust delivered from the drafting parts 6 and 7 but not sucked by the nozzle 1 is sucked by the sucked air current 20 smoothly into the dust box 3, without being deposited on or near the nozzle tip. The fly waste and dust discharged from the first nozzle 5 are sucked by discharged air current 17 into the dust box 3 as well, without reentering the drafting parts 6 and 7.

Since the upper end of the rectifier plate 13 in the above embodiment is adapted to be slightly higher than that of the front roller 6 and close to the cradle cover 16, the air current passing across the nozzle 1 is rectified as well. And, as the front wall 18 of the lower half part **13*b* of the rectifier plate 13 is shaped so as to gradually expand forward with the downward air flow, the air current 20 on the nozzle tip side is smoothly introduced into the suction pipe 2 without creating air turbulence within said dust box 3**.

Figure 4:
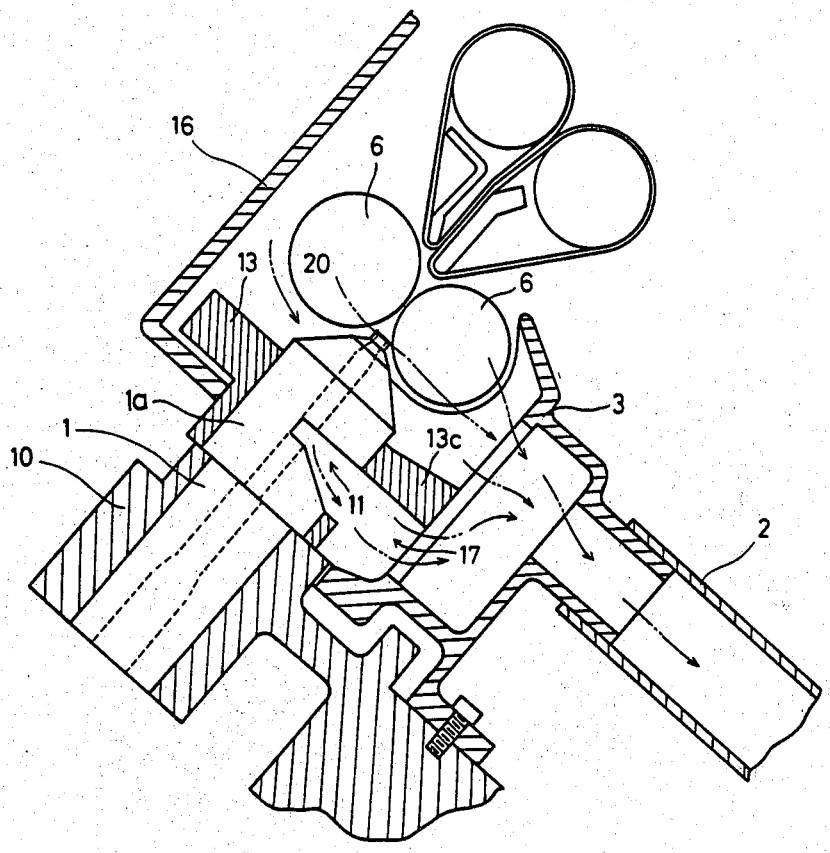
FIG. 4 is a sectional view showing another embodiment of the invention.

In the above embodiment, a wide air flow path 17 is formed by providing a cutout hole 11 bored in the lower half part **13*b* of the rectifier plate 13. However, it may be replaced by other differently formed air flow paths, as in the embodiment shown in FIG. 4, with rectifier plate 13 shaped into a flange-like configuration whose flange portion 13*c* is positioned between the air nozzle tip 1*a* and the air discharge port 11 of the first nozzle 5. The back side of said flange portion 13*c* is adapted to serve as an air flow path 17 on the base end side of the air nozzle. The embodiment of the invention illustrated in FIG. 4 provides additional access for the cleaning and maintenance of air discharge port 11 when rectifier plate 13** is rotated.

As is apparent from the foregoing description, in the air spinning device equipped with an air current rectifier plate according to the present invention, the air current in the nozzle tip portion is appropriately rectified and, consequently, fly fibers and dust are not deposited in said air nozzle tip portion, thereby effectively preventing troubles and occurrence of yarn breakage and other defects.

What is claimed:

1. An air current rectifier plate for use in an air spinning device characterized in that the rectifier plate is externally fitted on an air nozzle tip part which protrudes from a nozzle holder and includes a discharge port spaced from the tip of the nozzle, wherein the rectifier plate includes a lower part which is positioned between said air nozzle tip and the discharge port wherein at least a space communicating with the interior of a dust box disposed below said air nozzle tip part is substantially partitioned into two air flow paths separated by said lower part, one on the side of the air nozzle tip and the other for discharged air from the discharge port.

2. An air current rectifier plate as set forth in claim 1 wherein said rectifier plate is shaped like a disk so as to be fitted into the dust box provided under the air nozzle.

3. An air current rectifier plate is set forth in claim 2 wherein said rectifier plate is externally fitted onto the tip part of the air nozzle rotatably and slidably.

4. An air current rectifier plate as set forth in claim 3 wherein the upper half part of said rectifier plate is provided with a step for positioning with which the edge of a cradle cover is brought into contact to accurately position said rectifier plate with respect to the nozzle tip and discharge port.

5. An air current rectifier plate as set forth in claim 4 wherein the upper half part of said rectifier plate extends above the uppermost edge of a front roller disposed in front of the air nozzle.

6. A jet spinning device for producing spun yarn comprising:

drafting means for drafting said yarn;

fluid jet means for spinning said yarn;

fluid suction means for removing debris from said fluid jet means and said drafting means and environment;

fluid rectifying means, adjacent said fluid jet means, for directing said debris into said fluid suction means in a non-turbulent manner.

7. A device as in claim 6 wherein said fluid rectifying means further comprises:

barrier means for preventing said debris that is discharged from said fluid jet means from re-entering said fluid jet means or said drafting means.

8. A device as in claim 7 wherein said barrier means further comprises a disk radially disposed about said fluid jet means.

9. A device as in claim 8 wherein said disk may be rotated about said fluid jet means.

10. A device as in claim 8 or 9 wherein said fluid jet means comprises:

first nozzle means;

second nozzle means subsequent to said first nozzle means;

fluid discharge means, located between said first and second nozzle means, through which fluid and debris may be discharged from said fluid jet means.

11. A device as in claim 10 wherein said barrier means is configured so as to allow said discharged fluid and debris to enter said fluid suction means.

12. A device as in claim 6 wherein said fluid suction means further comprises:

dust box means; and suction pipe means.

13. A device as in claim 12 wherein the opening to said dust box means encompasses said drafting means and said fluid jet means.

* * * * *